US005643099A

United States Patent [19]

Solheim

[11] Patent Number: 5,643,099

[45] Date of Patent: Jul. 1, 1997

[54] GOLF CLUB HEAD WITH VISUAL INDICATORS

[75] Inventor: John A. Solheim, Phoenix, Ariz.

[73] Assignee: Karsten Manufacturing Corporation, Phoenix, Ariz.

[21] Appl. No.: 729,515

[22] Filed: Oct. 11, 1996

Related U.S. Application Data

[63] Continuation of Ser. No. 574,449, Dec. 15, 1995, abandoned.

[51] Int. Cl.[6] ..... A63B 53/04; A63B 69/36

[52] U.S. Cl. ..... 473/238; 473/331

[58] Field of Search ..... 473/324, 330, 473/331, 341, 342, 349, 350, 219, 238, 242, 252, 253, 257, 282, 290, 314

[56] References Cited

U.S. PATENT DOCUMENTS

| | | |
|---|---|---|
| Re. 19,178 | 5/1934 | Spiker . |
| D. 193,198 | 9/1962 | Davis . |
| 1,569,212 | 1/1926 | Aitken . |
| 2,520,950 | 9/1950 | Miller . |
| 3,693,978 | 9/1972 | East . |
| 3,722,887 | 3/1973 | Cochran . |
| 4,077,632 | 3/1978 | Taylor . |
| 4,512,577 | 4/1985 | Solheim . |
| 4,621,813 | 11/1986 | Solheim . |
| 4,792,140 | 12/1988 | Yamaguchi . |
| 4,900,028 | 2/1990 | Antonius . |
| 4,907,806 | 3/1990 | Antonius . |
| 5,082,278 | 1/1992 | Hsien . |

*Primary Examiner*—Sebastiano Passaniti
*Attorney, Agent, or Firm*—Darrell F. Marquette

[57] ABSTRACT

A golf club head includes a heel end, a toe end, and a front face arranged for impact with a golf ball. A plurality of elongated grooves are formed in the front face of the body. A pair of visual indicators are provided on the front face and are aligned with one of the grooves. One of the visual indicators is aligned with a heel end of the groove, and the other visual indicator is aligned with a toe end of the groove. When the club head is placed at "address" behind a golf ball, the visual indicators are utilized in a manner to position the club head so that the elongated grooves in the front face lie perpendicular to an intended target line. This prevents the club head from being inadvertently positioned with the front face "open" or "closed".

4 Claims, 5 Drawing Sheets

GOLF CLUB HEAD WITH VISUAL INDICATORS

This application is a continuation of application Ser. No. 08/574,449 filed Dec. 15, 1995 now abandoned.

BACKGROUND OF THE INVENTION

This invention relates generally to golf equipment and, in particular, to a golf club head with visual indicators for use in properly positioning the golf club head.

Golf club heads have typically included a body having a front face which impacts a golf ball. A plurality of elongated grooves are formed on the front face of the body. It has become customary to fill one of these elongated grooves with paint for use as a visual reference for positioning the club head so that the front face lies perpendicular to an intended target line. This visual reference is useful in preventing the club head from being positioned with its front face "open" or "closed". A drawback of this visual reference is that the paint in the groove is quickly covered with dirt or is removed by repeated contact between the front face and a golf ball.

SUMMARY OF THE INVENTION

The present invention provides a golf club head comprising a body having a heel end, a toe end, a front face arranged for impact with a golf ball, and a plurality of grooves formed in the front face. The grooves are elongated in a heel to toe direction extending between the heel and toe ends of the body. A pair of visual indicators are disposed on the front face and are aligned with one of the grooves for positioning the golf club head so that the grooves lie perpendicular to an intended target line. One of the visual indicators is disposed adjacent a heel end of the one groove, and the other visual indicator is disposed adjacent a toe end of the one groove. When the visual indicators are utilized, the golf club head will not be inadvertently positioned with the front face "open" or "closed".

DESCRIPTION OF THE PREFERRED EMBODIMENT

Figure 1:
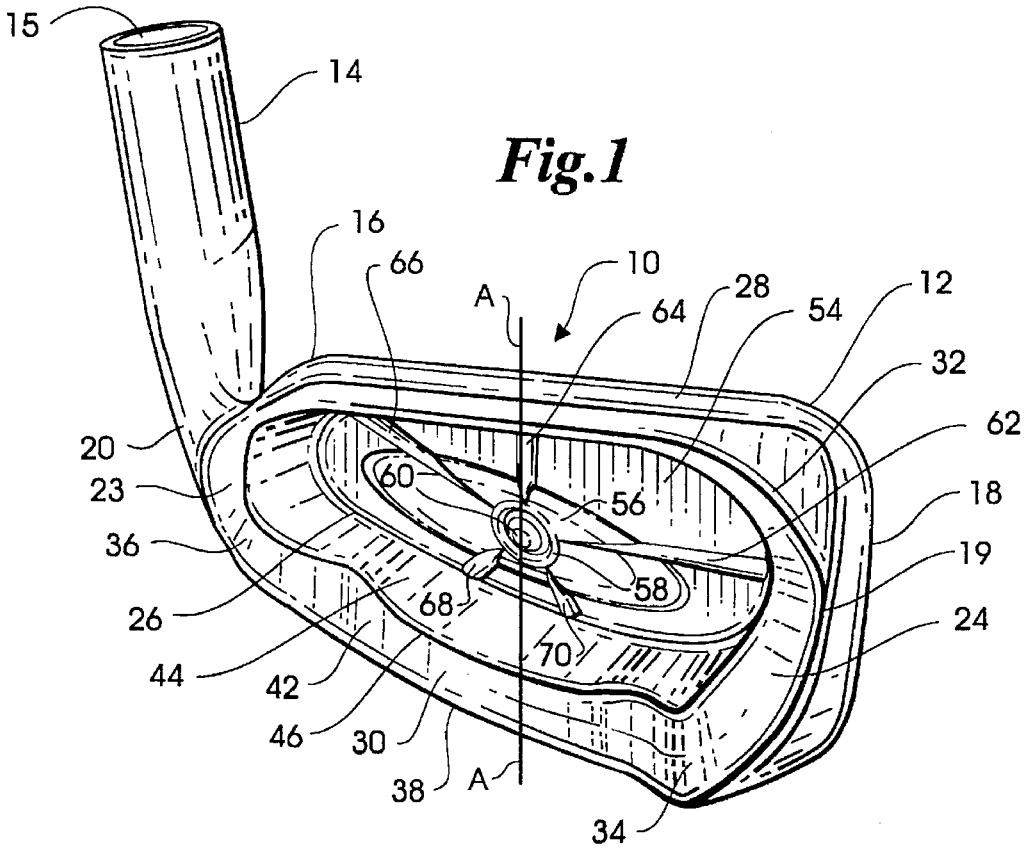
FIG. 1 is a perspective view of a golf club head incorporating the preferred embodiment of the present invention.
Figure 2:
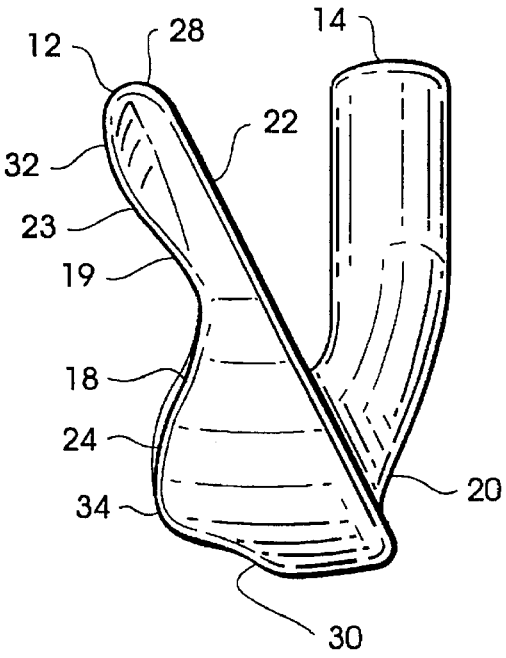
FIG. 2 is a toe end view of the golf club head of FIG. 1.
Figure 3:
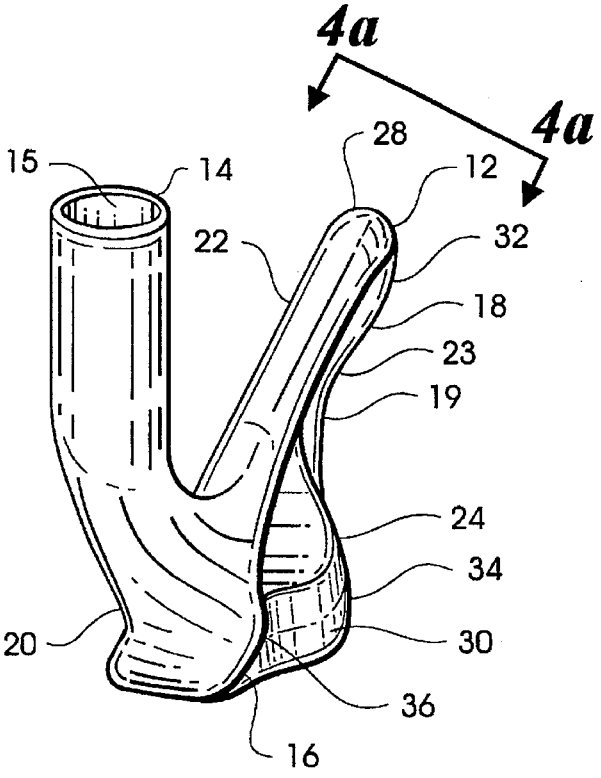
FIG. 3 is a heel end view of the golf club head of FIG. 1.

Referring to FIGS. 1–7, a golf club head 10 according to the preferred embodiment of the present invention includes a body 12 and a hosel 14 with a cylindrical bore 15 for receiving a golf club shaft (not shown). Although the club head 10 is shown as a five-iron, it could be any iron-type club head from a one-iron to a wedge. The body 12 has a heel end 16 and a toe end 18 that are spaced apart. The hosel 14 is adjacent the heel end 16 of the body 12 and includes a neck 20 which has a reduced thickness as described in U.S. Pat. No. 4,512,577 to Karsten Solheim. The body 12 and the hosel 14 are preferably cast from suitable metal such as beryllium copper or stainless steel. A front face 22 for arranged for impact with a golf ball (not shown) is provided on the body 12 and extends between the body heel and toe ends 16, 18 along a frontal portion of the body 12. Disposed rearwardly of the front face 22 is a back face 23.

A perimeter weighting element 24 protrudes rearwardly away from the front face 22 and defines a cavity 26 in the back face 23. The perimeter weighting member 24 includes a top rail 28 and a sole 30. The cavity 26 is defined at its upper extremity by the top rail 28 and at its lower extremity by the sole 30. The top rail 28 extends between the body heel and toe ends 16, 18 along an upper portion of the body 12, and the sole 30 extends between the body heel and toe ends 16, 18 along a lower portion of the body 12. The perimeter weighting element 24 also includes an upper toe weight 32 adjacent a toe end of the top rail 28, a lower toe weight 34 adjacent a toe end of the sole 30, and a lower heel weight 36 adjacent a heel end of the sole 30. The toe end 18 of the body 12 has a back edge 19 that is indented toward the front face 22 between the top rail 28 and the sole 30 separating the upper toe weight 32 from the lower toe weight 34.

The upper and lower toe weights 32, 34 and the lower heel weight 36 provide the club head 10 with resistance to twisting movement about a vertical axis A through the body 12 as a result of the front face 22 impacting a golf ball near the heel end 16 or the toe end 18 of the body 12. The sole 30 has a lower trailing edge 38 that includes an indentation 40 between the lower heel and toe weights 34, 36 as described in U.S.Pat No. 4,621,813 to Karsten Solheim. Located adjacent the lower trailing edge 38 of the sole 30 is a lower backsurface 42 of the perimeter weighting element 24. This lower backsurface 42 preferably slopes upwardly and inwardly from the trailing edge 38 toward the front face 22. The lower backsurface 42 merges with a lower innersurface 44 of the perimeter weighting element 24 along an upper trailing edge 46 of the sole 30. The indentation 40 and the sloping orientation of the lower backsurface 42 serve to redistribute material in the body 12 in a manner that increases the relative sizes of the lower heel and toe weights 34, 36 thereby increasing the resistance of the club head 10 to the above-mentioned twisting movement.

Figure 4:
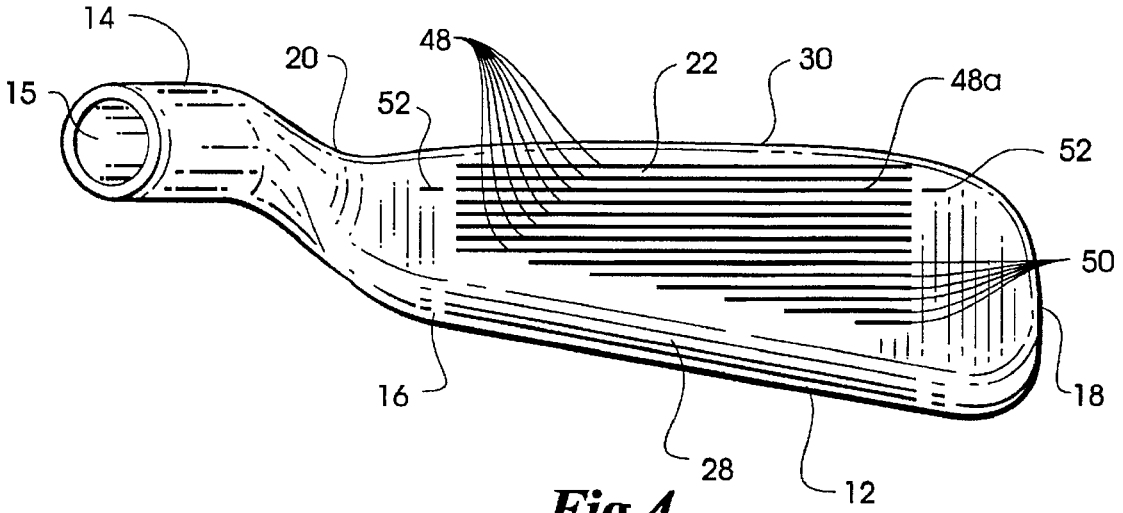
FIG. 4 is a top view of the golf club head of FIG. 1.
Figure 4A:
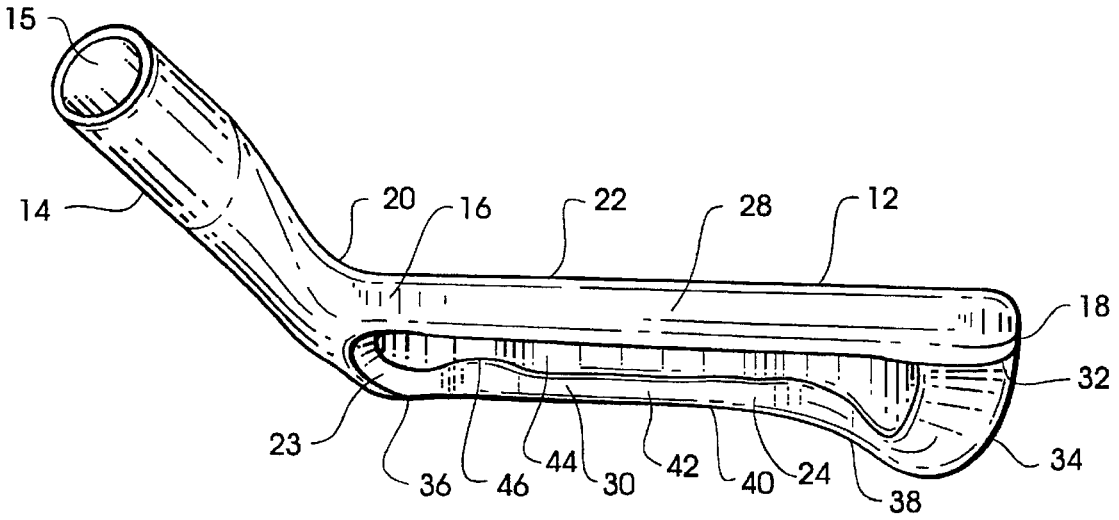
FIG. 4*a* is a view of the golf club head of FIG. 1 taken along lines 4—4 in FIG. 3.
Figure 5:
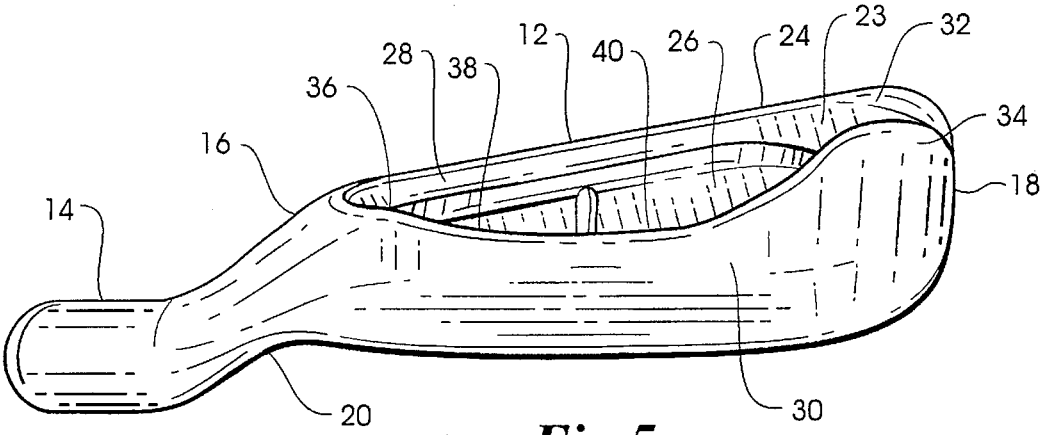
FIG. 5 is a bottom view of the golf club head of FIG. 1.
Figure 6:
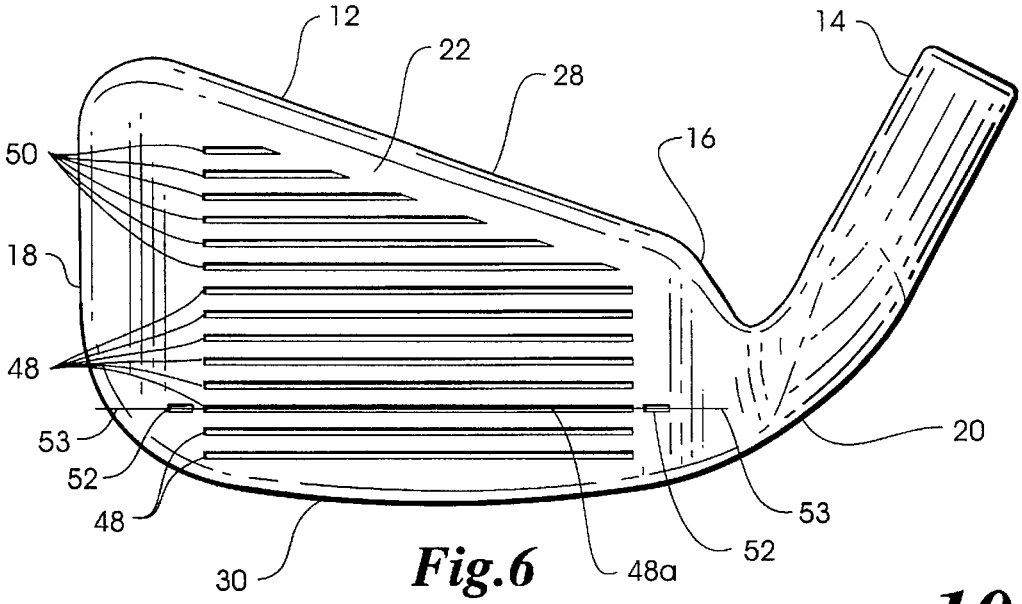
FIG. 6 is a front elevational view of the golf club head of FIG. 1.
Figure 7:
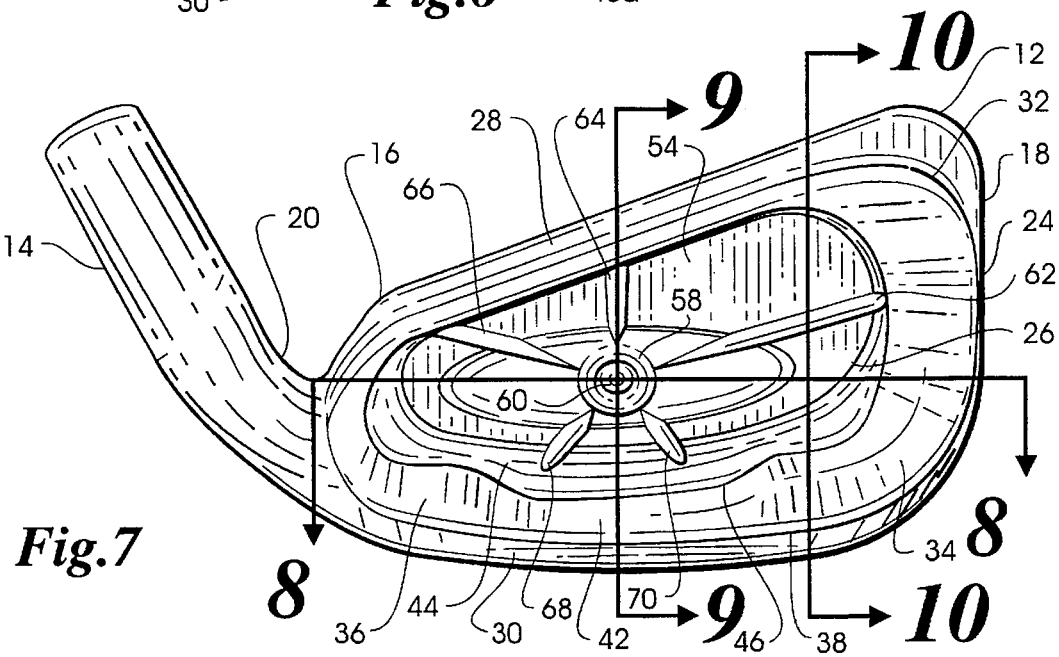
FIG. 7 is a rear elevational view of the golf club head of FIG. 1.
Figure 8:
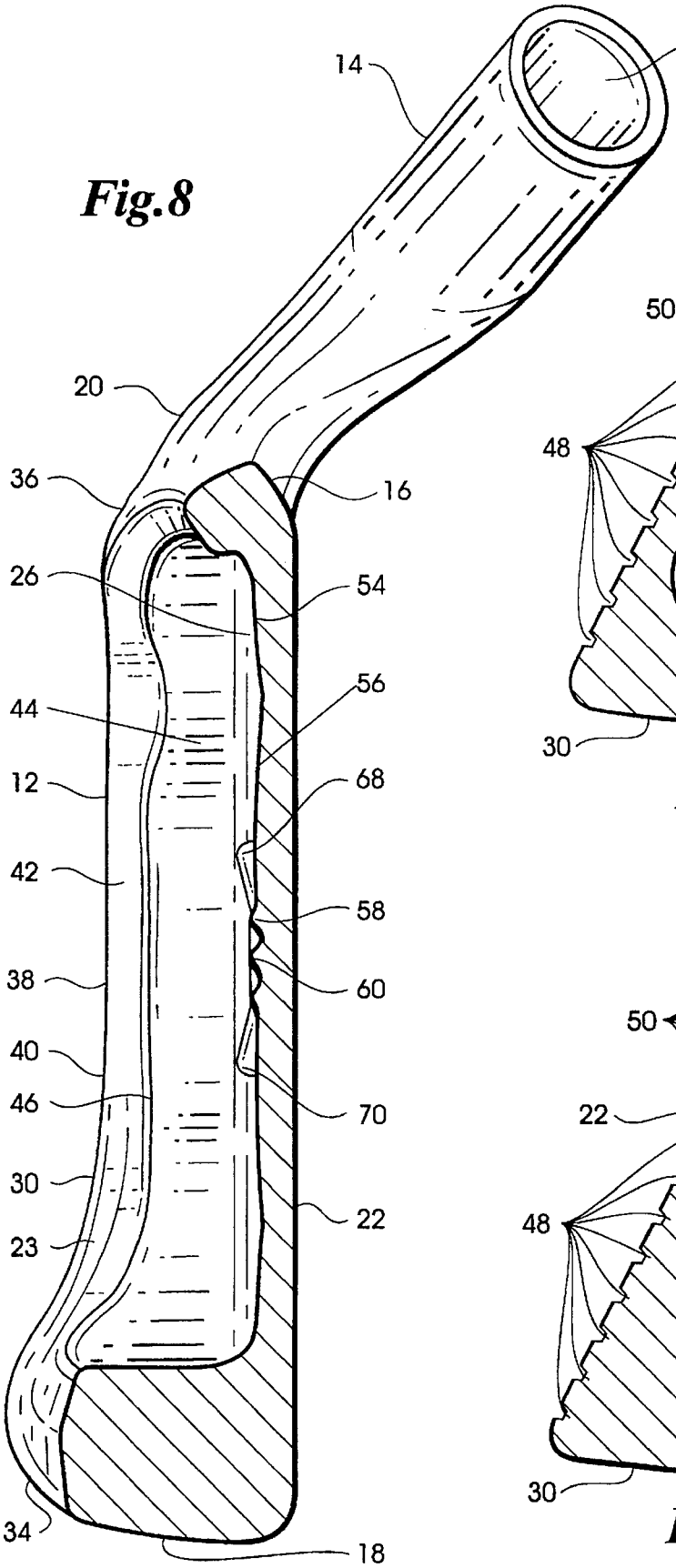
FIG. 8 is an enlarged cross-sectional view taken along lines 8—8 in FIG. 7.
Figure 9:
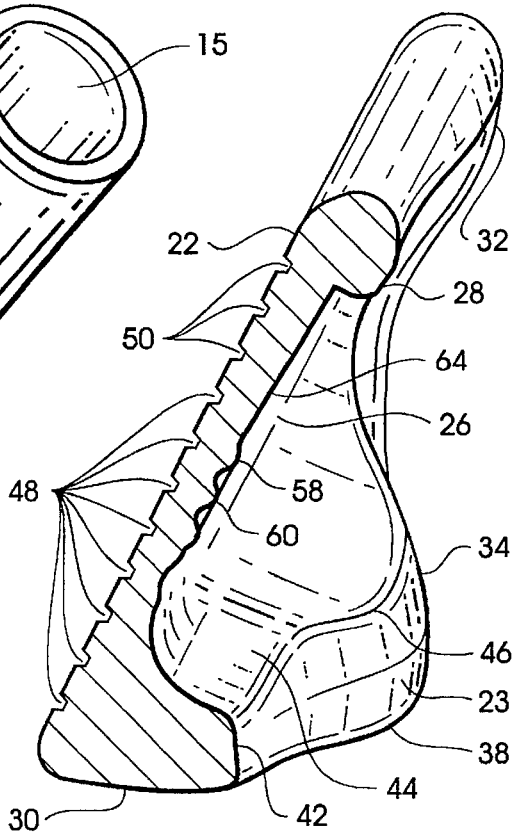
FIG. 9 is an enlarged cross-sectional view taken along lines 9—9 in FIG. 7.

As seen in FIGS. 4 and 6, a plurality of grooves 48, 50 are formed in the front face 22 of the body 12. The grooves 48, 50 are elongated in a heel to toe direction extending between the heel and toe ends 16, 18 of the body and include a set of eight grooves 48 of equal length which form and lie inside a rectangular shape on the front face 22 and a set of six grooves 50 of varying length. Each of the grooves 48, 50 has a width dimension and a length dimension. A pair of shortened grooves 52 (approximately ⅛ inch long) are provided in the front face 22 outside the rectangular shape formed by the grooves 48 aligned with the groove that is designated 48*a*. These shortened grooves 52 serve as visual indicators and are preferably filled with a contrasting color of paint so that they are highly visible. As seen in FIG. 6, the visual indicators 52 are aligned with respect to each other and are located on an imaginary line 53 extending in the heel to toe direction. One of the visual indicators 52 Is disposed adjacent and laterally offset from a heel end of the groove 48*a*, and the other visual indicator 52 is disposed adjacent and laterally offset from a toe end of the groove 48*a*. Each visual indicator 52 is elongated in the heel to toe direction and has a width dimension that is substantially equal to the width dimension of the grooves 48, 50 and a length dimension that is substantially less than the length dimension of the grooves 48, 50. In the preferred embodiment of the club head 10, the length dimension of each visual indicator 52 is greater than its width dimension. When the club head 10 is placed at "address" behind a golf ball, the grooves or visual indicators 52 are utilized by a golfer in a manner to position the club head 10 so that the grooves 48 and 50 lie perpendicular (i.e. square) to an intended target line. If the visual indicators 52 are utilized in this manner, the club head 10 will not be inadvertently positioned with the front face 22 "open" or "closed".

It will be understood that the visual indicators 52 must be aligned with the opposite ends of the same groove 48 or 50 in order for the club head 10 to be properly positioned at "address". In club heads such as a wedge (not shown) where the front face 22 is disposed at a higher loft angle than in the club head 10, the visual indicators 52 are preferably aligned with a groove that is below the groove 48*a* in order to be more visible. In club heads such as a one-iron (not shown) where the front face 22 is disposed at a lower loft angle than in the club head 10, the visual indicators 52 are preferably aligned with a groove that is above the groove 48*a* so that they are more visible.

Although the visual indicators 52 have been described above in connection with iron-type club heads such as the club head 10, they may also be used on wood-type club heads such as that shown in U.S. Pat. No. 5,294,037.

Figure 10:
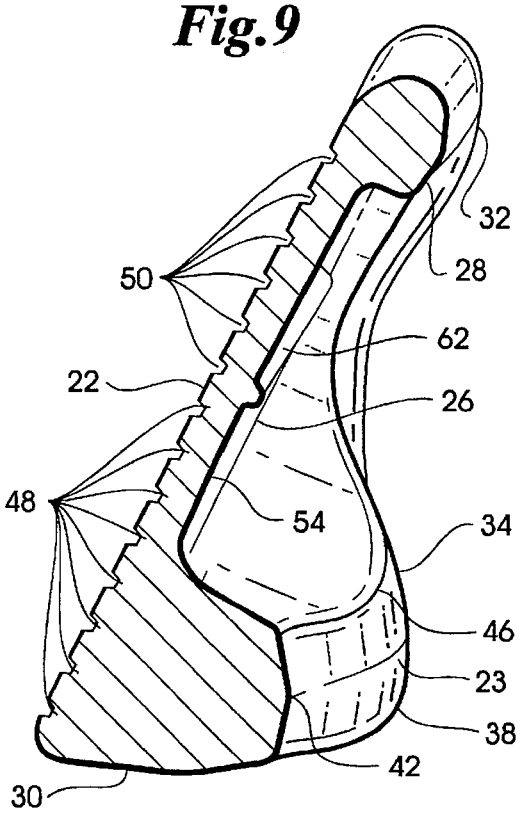
FIG. 10 is an enlarged cross-sectional view taken along lines 10—10 in FIG. 7.
Figure 11:
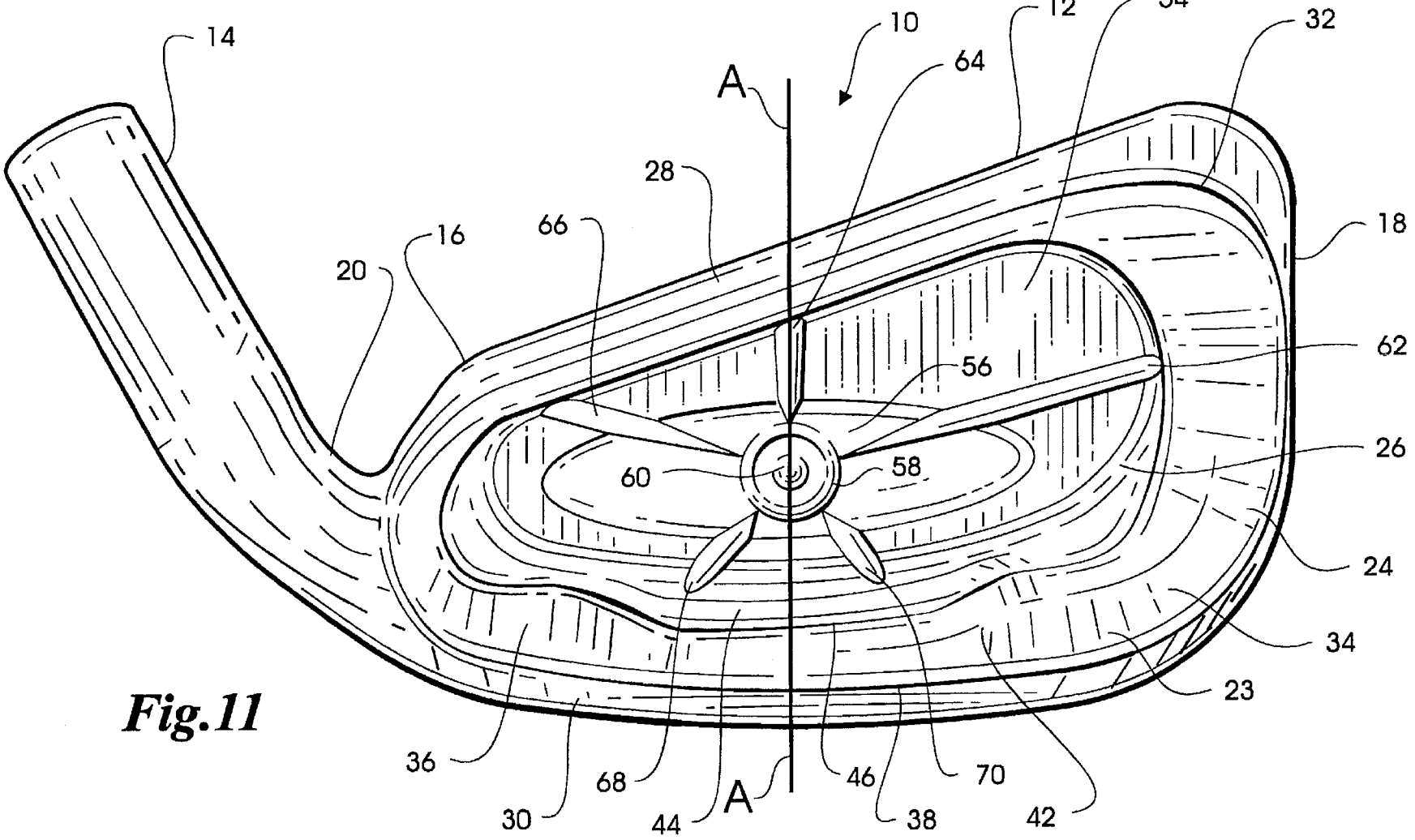
FIG. 11 is an enlarged rear elevational view of the golf club head of FIG. 1.

Referring to FIG. 11, the cavity 26 defined by the perimeter weighting element 24 has a bottom surface 54. Formed in the bottom surface 54 is an elliptically shaped geometric region 56, and formed integrally with and rising above the region 56 are a ring 58 and a projection 60. The ring 58 encircles the center of gravity of the club head 10 and the projection 60. Disposed in the cavity 26 is a plurality of five ribs 62, 64, 66, 68 and 70. Each of the ribs 62–70 extends generally radially relative to the cavity 26 from an inner end proximate the ring 58 to an outer end that merges with the perimeter weighting element 24. The rib 62 extends toward the toe end 18 of the body 12. The ribs 64 and 66 extend toward the top rail 28, and the ribs 68 and 70 extend toward the sole 30. As shown in FIG. 10, the ribs 62–70 each have an arch shaped cross-section.

If the front face 22 of the club head 10 impacts a golf ball at the center of gravity of the body 12 (i.e. at the projection 60), no undesirable vibrations are produced. However, if the front face 22 impacts a golf ball near the body heel end 16 or the body toe end 18, undesirable vibrations are eliminated by the ribs 62–70 and by the geometric region 56 and the ring 58. Other vibrations are attenuated by the ribs 62–70, the geometric region 56 and the ring 58. The ribs 62–70 account for about 85% of the total vibration elimination and attenuation while the geometric region 56 and the ring 58 account for about 15% of the vibration control. Vibration elimination refers to reduction of vibrations to a level that is not perceptible, and vibration attentuation refers to reduction of vibrations to a lower level that may still be perceptible.

Alternatively, the geometric region 56 may take the form of shapes other than an ellipse such as a diamond, a cloverleaf, a hexagon or a circle. Also, the ribs 62–70, 72–78 and 80–94 may be connected to the perimeter weighting element 24 by mechanical means rather than being integrally formed with the perimeter weighting element 24.

What is claimed is:

1. A golf club head comprising:

a body having a heel end, a toe end, a front face arranged for impact with a golf ball;

a plurality of generally parallel grooves formed in said front face, said grooves being of equal length and being elongated in a heel to toe direction extending between said heel and toe ends of said body, said grooves forming and lying inside a rectangular shape on said front face; and a pair of visual indicators disposed on said front face outside said rectangular shape for positioning the golf club head so that said grooves lie perpendicular to an intended target line, said pair of visual indicators being located on an imaginary line extending substantially parallel to said grooves in said heel to toe direction, one of said visual indicators being located outside said rectangular shape adjacent said heel end of said body, the other visual indicator being located outside said rectangular shape adjacent said toe end of said body.

2. The golf club head of claim 1, wherein said visual indicators comprise a pair of shortened grooves formed in said front face.

3. The golf club head of claim 2, wherein said shortened grooves are filled with paint.

4. The golf club head of claim 1, wherein said one visual indicator is aligned with and laterally offset from a heel end of one of said grooves, and wherein said other visual indicator is aligned with and laterally offset from a toe end of said one groove.

* * * * *